US006530803B1

(12) United States Patent
Chen

(10) Patent No.: US 6,530,803 B1
(45) Date of Patent: Mar. 11, 2003

(54) STRUCTURE OF A CABLE PIN

(75) Inventor: Tung I Chen, Taipei (TW)

(73) Assignee: Leong C. Lei, Taipei (TW)

( * ) Notice: Subject to any disclaimer, the term of this patent is extended or adjusted under 35 U.S.C. 154(b) by 0 days.

(21) Appl. No.: 10/092,585

(22) Filed: Mar. 8, 2002

(51) Int. Cl.[7] ..... H01R 13/58

(52) U.S. Cl. ..... 439/449; 439/465; 174/159; 227/120

(58) Field of Search ..... 439/449, 465, 439/469; 174/135, 159; 227/120

(56) References Cited

U.S. PATENT DOCUMENTS 4,697,045 A * 9/1987 Beatty ..... 174/159
4,801,064 A * 1/1989 Mangone, Jr. ..... 227/120
5,735,444 A * 4/1998 Wingert ..... 227/120

* cited by examiner

*Primary Examiner*—Tho D. Ta
*Assistant Examiner*—Truc Nguyen
(74) *Attorney, Agent, or Firm*—Leong C. Lei

(57) ABSTRACT

An improved structure of a cable pin is disclosed. The cable pin has a An improved structure of a cable pin having a cable-pressing body for pressing against a cable, characterized in that the top face of the body is provided with a pin slot corresponding to a cable pin, and the center bottom face of the body is formed into a downward facing notch being elongated, flat as a first cable slot, the center top face of the first cable slot is formed into a second cable slot, wherein the width of the second pin slot is narrower than the width of the first cable slot, thereby the cable pin structure can be employed to fasten cable of various sizes and shapes without damaging the cable.

1 Claim, 3 Drawing Sheets

STRUCTURE OF A CABLE PIN

BACKGROUND OF THE INVENTION 1. (a) Technical Field of the Invention

The present invention relates to cable pin used to fasten cable onto a surface.

2. (b) Description of the Prior Art

Taiwanese Utility Patent No. 214756, entitled "Structure of cable pin" and Taiwan Utility Patent No. 252381, entitled "Improved structure of cable pin" both disclose structure of cable pin which is used to fasten wire without damaging the conductor within the wire and the damaging of circuit However, the notch of the cable pin is normally a flat-shaped notch or an arch-shaped notch, therefore, the flat-shaped notch can only use for fastening flat wires. If the wire is round, due to insufficient depth of the notch, the interior of the conductor will be damaged. If his pin is applied to the round cable with a small diameter, due to the wide notch, the wire will slide within the notch and the wire will not be fasten at the correct position, and the appearance of the entire appearance of cable will be destroyed.

As for Taiwan Utility Patent No. 252381, the notch is a circular shape which can be applied to circular wire. However, it is not applicable to flat wire. Besides, due to insufficient wide of the notch, the sides of wires may be damaged and if the pin is used to fasten small diameter wire, the wire will move up and down within the notch. Accordingly, it is an object of the present invention to provide an improved structure of a cable pin which mitigates the above drawbacks.

SUMMARY OF THE INVENTION

Accordingly, an object of the present invention to provide an improved structure of a cable pin having a cable-pressing body for pressing against a cable, characterized in that the top face of the body is provided with a pin slot corresponding to a cable pin, and the center bottom face of the body is formed into a downward facing notch being elongated, flat as a first cable slot, the center top face of the first cable slot is formed into a second cable slot, wherein the width of the second pin slot is narrower than the width of the first cable slot, thereby the cable pin structure can be employed to fasten cable of various sizes and shapes without damaging the cable.

A further object of the present invention is to provide an improved structure of a cable pin, wherein a plurality of connection points are formed between adjacent cable-pressing bodies such that the cable pins can be formed into a series for use in an automatic stapler.

The foregoing object and summary provide only a brief introduction to the present invention. To fully appreciate these and other objects of the present invention as well as the invention itself, all of which will become apparent to those skilled in the art the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
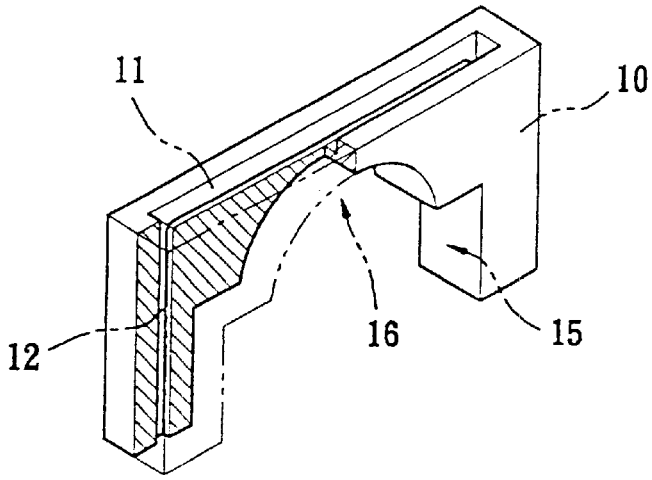
FIG. 1 is a perspective partial sectional view of a cable pin in accordance with the present invention.

Referring to FIG. 1, there is shown a cable pin 20 having an arch-shaped body 10, wherein the cable pin 20 can either be arch-shaped, "II"-shaped or "I"-shaped. In accordance with the present invention, the cable pin 20 is an arch-shaped.

As shown in FIGS. 1 and 2, the top face of the body is provided with a pin slot 11 located transversely across the cable pin 20. The lateral sides of the body 10 are provided with a through pinhole 12 corresponding to the vertical rod of the cable pin 20, allowing the cable pin 20 to be inserted The center of the bottom face of the body 10 is formed into a downward opening as a first wire slot 15 which is an elongated flat shaped slot. The center of the top face of the body 10 is formed into a second cable pin 16. The second cable slot can be either a semi-circular shaped, rectangular shaped, triangular shaped. The width of the second cable slot 16 is narrower than the first cable slot 15. The present structure has the first cable slot 15 to adapt the flat shaped cable pin 50 and has the second cable slot 16 to hold a round shaped cable pin.

Figure 2A:
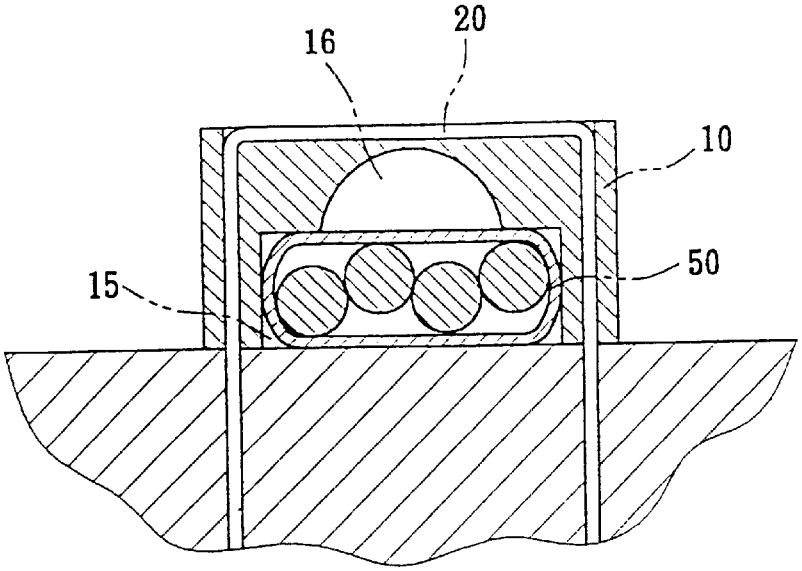
FIGS. 2A and 2B show sectional views of mounting cables with cable pin in accordance with the present invention.
Figure 2B:
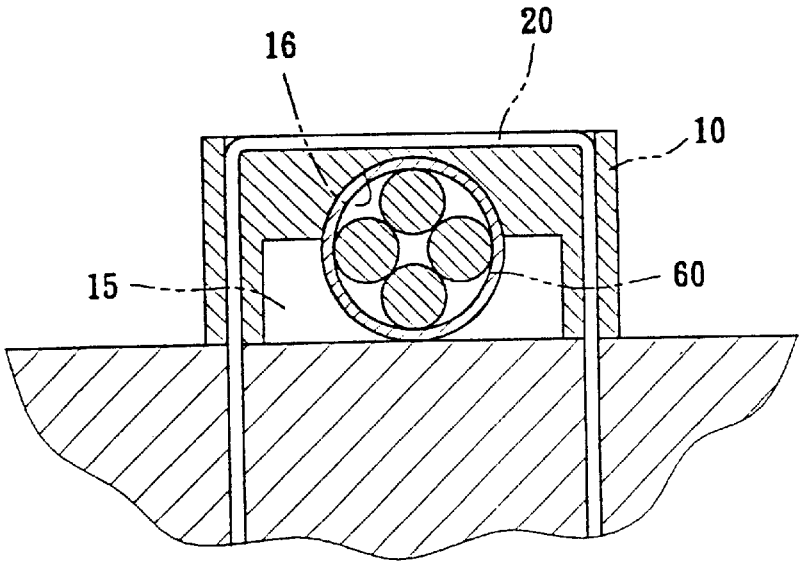

In application of the cable pin, as shown in FIG. 2, if the cable pin is to be used to fasten flat shaped cable 50 (as shown in FIG. 2A), the body 10 employs the first cable slot 15 to press against the wire 50. As the wide of the first cable slot 15 is sufficient to fasten the cable 50, the sides of the cable 50 will not be damaged. If the top face of the first cable slot 15 is used to press the cable 50, the cable 50 will be firmly secured. If the cable pin is applied to fasten a round cable 60 (as shown in FIG. 2B), the body 10 has the second cable slot 16 to press against the cable 60. As the height of the second cable slot 16 is higher than the height of the first cable slot 15, the cable 60 will not be damaged. At the same time, the sides of the second cable slot 16 restrict the cable 60 and therefore the cable 60 is fastened.

In accordance with the present invention, the cable pin can be utilized to fasten cables 50, 60 of various shapes and at the same time, the cables 50, 60 are not damaged but the cables 50, 60 can be effectively fastened. In view of the above, the user employs only one pin punching machine or stapler to fasten cables 50, 60 of various shapes and sizes.

Figure 3:
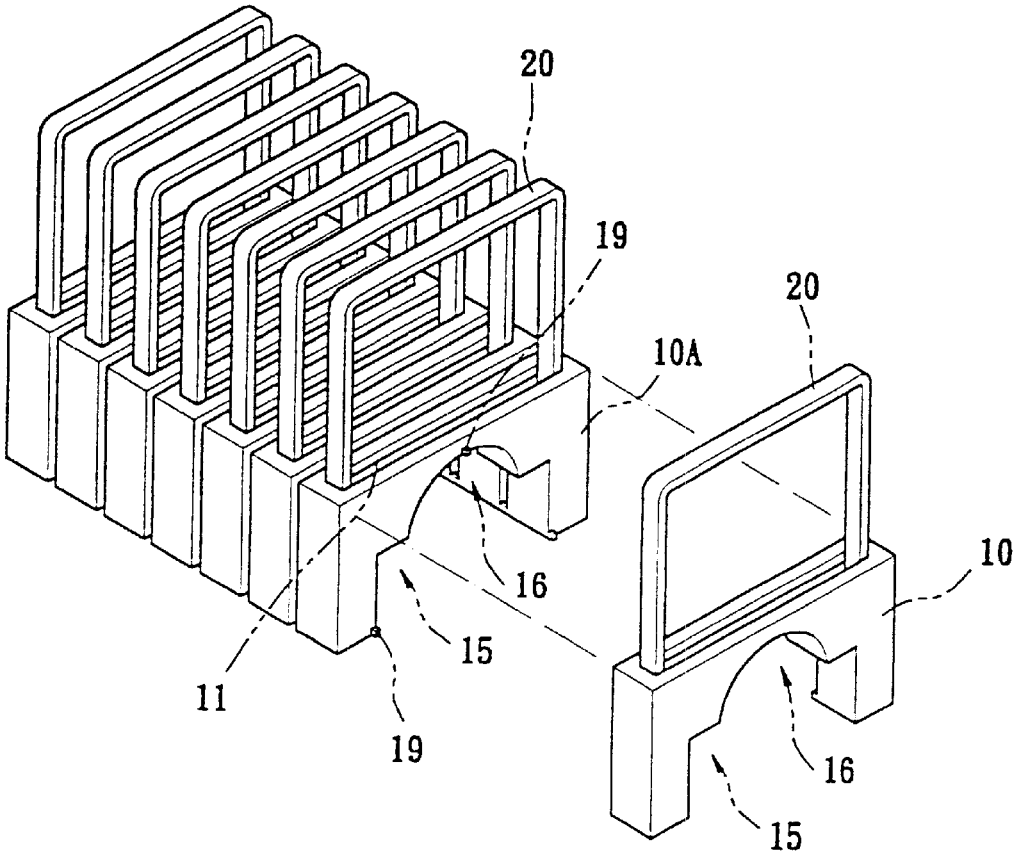
FIG. 3 is a perspective view of cable pins arranged in series in accordance with the present invention.

As shown in FIG. 3, the sides between the body 10, and 10A are provided with a plurality of connection points 19 such that the cable pins are connected in series.

Figure 4:
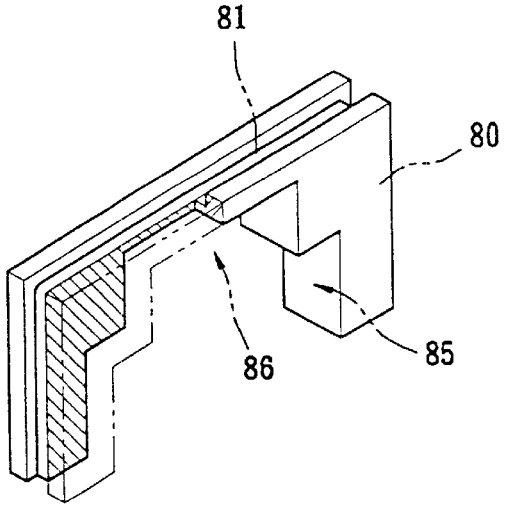
FIG. 4 is a perspective partial sectional view of a cable pin of another preferred embodiment in accordance with the present invention.
Figure 5:
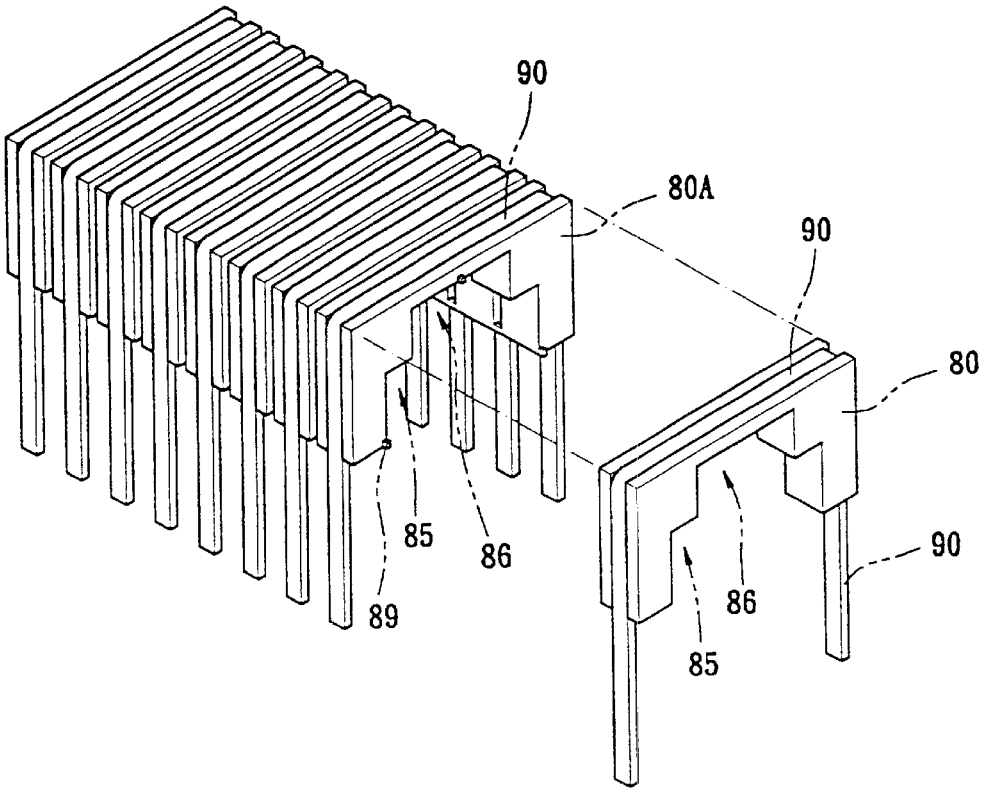
FIG. 5 is a perspective view of cable pins arranged in series of another preferred embodiment in accordance with the present invention.

FIG. 4 is another preferred embodiment of the cable pin in accordance with the present invention. The body 80 is a "II" shaped and the surrounding edge of the body 80 is provided with a pin slot 81 corresponding to a cable pin 90 allowing the cable pin 90 to restrict the body 80. The center of bottom face of the body 80 is formed into an elongated flat shaped cable slot 85 to press against a flat shaped cable 50. The center of the top face of the first cable slot 85 has a narrower second cable slot 86, wherein the second cable slot 86 is rectangular shape which can fasten round shaped cable 60, as shown in FIG. 5, a connection point 89 is provided to the body 80 and 80A so that body 80, 80A can be connected to form serially connected cable pins.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

What is claimed is:

1. An improved structure of a cable pin assembly comprising:

a cable pin; and a cable-pressing body for pressing against a cable characterized in that a top face of the body is provided with a pin slot for receiving the cable pin; wherein said cable-pressing body comprising a generally U-shape body defined by said top face and two side legs, each of said side leg includes an inner side face and an outer side face; wherein said inner side faces defining a slot which has an upper portion is defined from a mid portion of the legs up to and adjacent to said top face, and a lower portion is defined from said mid portion of the leg up to and adjacent to a distal end of said side legs; wherein said lower portion is generally substantially a rectangular shaped has a width is wider than a width of said upper portion, such that said slot can be employed to fasten said cable of various sizes and shapes without damaging said cable.

* * * * *